US006674984B2

(12) United States Patent
Ooka

(10) Patent No.: US 6,674,984 B2
(45) Date of Patent: Jan. 6, 2004

(54) METHOD AND APPARATUS FOR PRINTING IMAGE

(75) Inventor: Haruhi Ooka, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/105,441

(22) Filed: Mar. 26, 2002

(65) Prior Publication Data

US 2002/0191988 A1 Dec. 19, 2002

(30) Foreign Application Priority Data

Mar. 27, 2001 (JP) ..... P2001-090497

(51) Int. Cl.[7] ..... G03G 15/10; G03G 15/16

(52) U.S. Cl. ..... 399/237; 399/307; 399/308; 430/117; 430/126

(58) Field of Search ..... 399/237, 307, 399/297, 302, 308, 318, 66; 430/117, 126

(56) References Cited

U.S. PATENT DOCUMENTS 4,796,047 A * 1/1989 Fowlkes et al. ..... 399/318 X
5,242,777 A * 9/1993 Kato et al. ..... 430/109.5
5,708,950 A * 1/1998 Badesha et al. ..... 399/307 X
5,835,830 A 11/1998 Fukuda et al. ..... 399/307
6,356,731 B1 * 3/2002 Shinjo ..... 399/297
6,389,242 B1 * 5/2002 Watanabe ..... 399/237 X
6,453,128 B2 * 9/2002 Park ..... 399/307 X
2002/0146258 A1 * 10/2002 Iida et al. ..... 399/307

FOREIGN PATENT DOCUMENTS

JP 2001-60046 3/2001

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A method and an apparatus for printing an image on a print medium with a liquid developer which includes a liquid carrier and a toner dispersed in the liquid carrier. The image is printed by forming a toner image having the toner from the liquid developer, and transferring the toner image to the print medium under pressure. By adjusting a complex viscosity coefficient of the toner forming the toner image to be transferred to a value satisfying the formula: $1\times10^4<\eta<1\times10^6$, wherein $\eta$ represents the complex viscosity coefficient (Pa·s) of the toner, the toner image to be transferred to the print medium is controlled.

19 Claims, 9 Drawing Sheets

METHOD AND APPARATUS FOR PRINTING IMAGE

BACKGROUND OF THE INVENTION

1. Field of the Invention

The present invention relates to a method and an apparatus for printing an image using a liquid developer, and particularly relates to a method and an apparatus for printing an image in which transfer property of the developed image from the image retaining member to a print medium is excellently improved.

2. Related Art

In recent years, the value of a method of forming and printing an image using a liquid developer according to electrophotographic or electrostatic technologies has been re-evaluated, because it has advantages that are not fulfilled by the method utilizing a dry developer. Specifically, since the liquid developer is of the construction that toner particles are dispersed into a carrier liquid, extremely fine toner particles of submicron size are possibly employed. Therefore, in comparison with the image forming method of the dry development type, that of the liquid development type is advantaged mainly in that it can realize a high quality image, that it is economical since a sufficient image density is obtained by a small amount of toner, and that the realistic feeling comparable to the printing (specifically, offset printing) can be actually realized.

In the conventional electrophotographic image printing method of the liquid development type, a visible image developed on the surface of the latent image retaining member provides the final image by carrying out the electrophoresis in a carrier liquid through an electric field and by directly transferring the visible image to a print medium such as a paper or the like, or by transferring it once to the intermediate transfer medium before transferring it to the print medium.

However, such a transferring method by electrophoresis causes problems that the transfer efficiency of toner image is low, resulting in disordered image.

On the other hand, as a method of transferring a visible image developed on the surface of a latent image retaining member to a print medium, there is a method in which the latent image retaining member and the intermediate transfer medium are arranged to contact with one another under pressure, so that the developed visible image is transferred to the intermediate transfer medium by utilizing the pressure (and heat), which is disclosed in Japanese Patent Application Publication No. 46-41679, Japanese Patent Application Laid-Open No. 62-280882 and U.S. Pat. No. 5,650,253. The visible image is then subsequently transferred from the intermediate transfer medium to the paper. Alternatively, there is another transferring method in which the latent image retaining member is contacted with a sheet of paper under pressure so that the toner image is transferred direct to the paper by similarly utilizing the pressure (and heat). The transferring methods proposed in the above disclosures are superior to the transferring method using electrophoresis in the viewpoints of the transfer efficiency of the toner image and image deterioration at the time of transferring, and a higher quality image is thus obtained thereby.

Although these proposals have been employed, there is still a practical problem remaining, as follows.

Namely, in the case where a toner layer constituting the visible image is as thin as the thickness in the range from submicron to a few micrometers as in the image formation method using a liquid developer, if a paper whose surface is coarse such as PPC (Plain Paper Copier) paper or the like is used as a recording medium, the toner layer gets into the concave portions of the coarse paper under the pressur for transfering. As a result, the image density is reduced and the image quality is deteriorated.

BRIEF SUMMARY OF THE INVENTION

An object of the present invention is to provide a method and an apparatus of printing an image which are capable of providing a high quality image even on the cheap paper having a coarse surface in a long term, while employing a transferring system utilizing the pressure.

In order to achieve the above-described object, the method of printing an image on a print medium with a liquid developer which comprises a liquid carrier and a toner dispersed in the liquid carrier, according to the present invention, comprises: forming a toner image comprising the toner, from the liquid developer; transfering the toner image to the print medium under pressure; and controlling the toner image to be transferred to the print medium, to adjust the complex viscosity coefficient of the toner forming the toner image to be transferred, to a value satisfying the formula: $1\times10^4<\eta<1\times10^6$, wherein $\eta$represents the complex viscosity coefficient (Pa·s) of the toner.

The apparatus for printing an image on a print medium with a liquid developer which comprises a liquid carrier and a toner dispersed in the liquid carrier, according to the present invention, comprises: an image formation system which forms a toner image comprising the toner, from the liquid developer; a transfer mechanism which is arraged to transfer the toner image to the print medium under pressure; and a temperature controller which controls the temperature of the toner image to be transferred to the print medium to adjust complex viscosity coefficient of the toner forming the toner image to be transferred to the print medium to a value satisfying the formula: $1\times10^4<\eta<1\times10^6$, wherein $\eta$ represents the complex viscosity coefficient (Pa·s) of the toner.

BRIEF DESCRIPTION OF THE SEVERAL VIEWS OF THE DRAWINGS

The features and advantages of the printing method and apparatus according to the present invention over the proposed art will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE INVENTION

Figure 1:
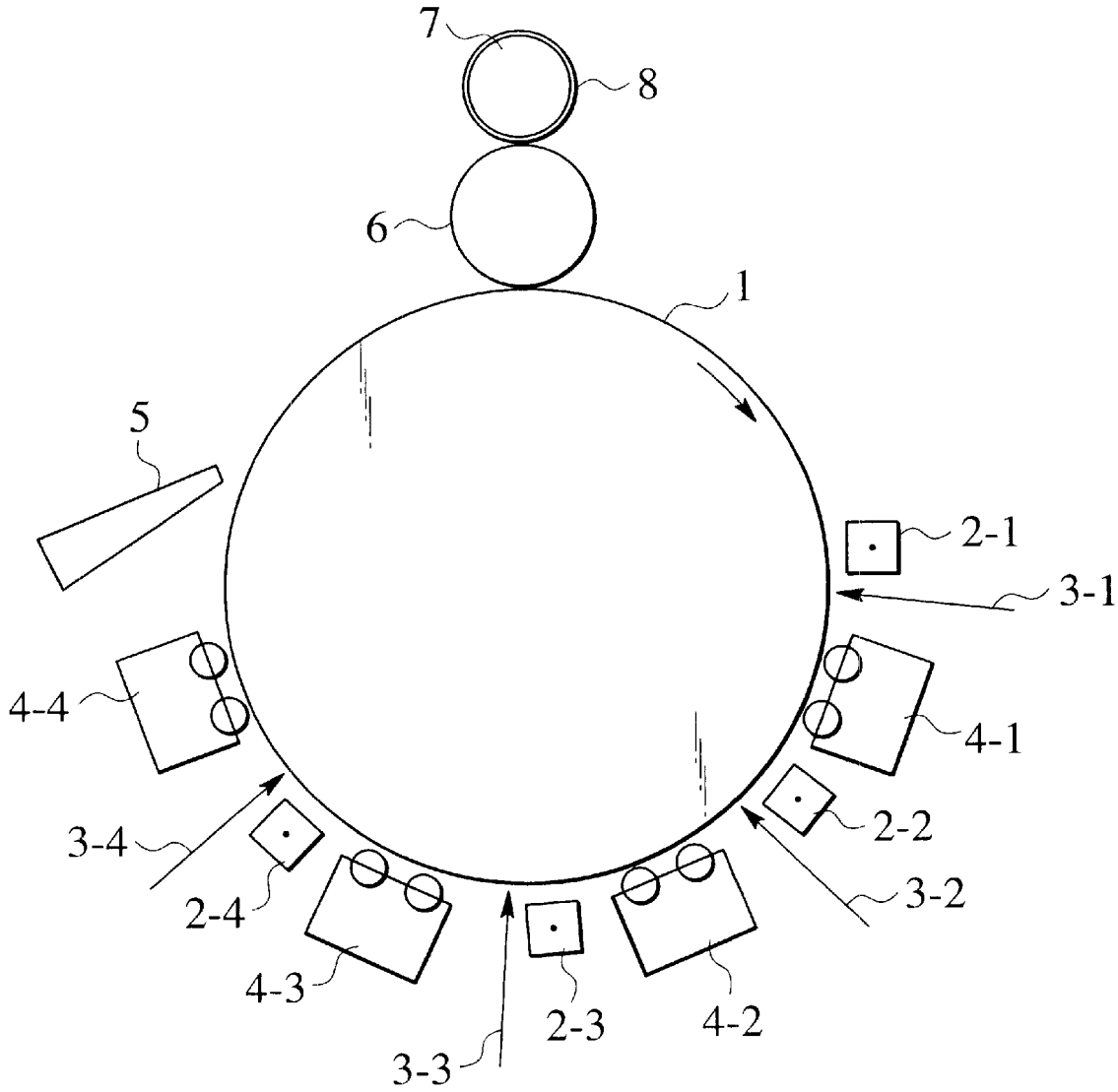
FIG. 1 is a schematic diagram showing an image printing apparatus of the first embodiment of the present invention.

The embodiment of the present invention will be described below in detail.

A liquid developer is a developer that a particulate solid toner or toner particles are dispersed in a carrier liquid having non-polarity, and an image is produced (developed or made visible) of a toner layer formed of the toner particles which are agglomerated and attached corresponding to the electrostatic latent image generated on the latent image retaining member. The particulate toner is manufactured by utilizing fine particles of a colorant and a binder resin, and viscosity of the toner changes depending on the state of the components composing the binder resin, etc. If the toner is transferred to the paper in the state where the viscosity coefficient of the toner is too high, transfer failure and deterioration of image quality may be caused since its adhesive force to the paper is weak. However, even when a toner whose viscosity coefficient in normal temperatures is comparatively high is used, the transfer property is possibly improved by providing heat during the transfer of the toner image. The reason for this improvement can be explained by the matter that the viscosity coefficient of the toner is reduced by heat and it is therefore easily attached to the paper. However, in this case, if a paper sheet whose surface is coarse is used as a print medium, the toner easily gets into the concave portions of the paper surface and the image density and image quality are lowered.

The inventor of the present application has found that the deterioration of image quality that is caused on the image transferred onto the coarse surface of paper concerns particularity the viscosity coefficient of the toner image. Specifically, when the transferred toner is in a state where the viscosity coefficient of the toner is excessively low, the toner easily gets into the concave portions of the surface of the paper and thus the image density is lowered. In other words, it is made possible to print an image of high quality and high density by adjusting the viscosity coefficient of the toner to an appropriate range, even when the paper with coarse surface is used. This adjustment can be actually achieved by controlling the temperature of the toner during the transfer.

Moreover, adhering property of the toner to the paper is capable of being improved by keeping the toner image in contact with the paper to a certain degree of time after the toner image is pressed to the paper. In other words, the transfer property of the toner image is possibly enhanced by designing the carrying pathway of the paper in such a manner that the paper after pressing to the toner image on the image carrying member such as a cylindrical intermediate transfer medium, the latent image retaining member or the like is transported with keeping in contact with the toner image for a predetermined time period, accompanied with the movement in the circumferential direction of the carrying surface of the image carrying member, before the paper is released from the image carrying member. Accordingly, even if the viscosity efficient of the toner image to be transferred is relatively high, the image is appropriately transferred and necessity of an increased transfer temperature is reduced. An image of high image quality can be recorded on a course surface of paper, using a toner having relatively high degree of viscosity. Moreover, even when the image outputting is performed at a high speed, it is also possible to prevent transfer failure, and the quality of output image is still high.

It is known that the image carrying member for carrying the formed image to be transferred to a print medium, which includes the latent image retaining member, the intermediate transfer medium and the like, is capable of having any shape of drums or belts in practical embodiments. In the embodiment of the present invention, it is preferred from the viewpoint of making the time to keep the contact with the paper and controlling the temperature of the toner image, to employ as an image carrying member an integral body in a drum shape whose thermal capacity is relatively large. In the case of an image carrying member having a drum shape, it is easier to control so that the temperature of the entity range is always equal. And, if the thermal capacity is large, the variation of temperature due to the local cooling or the like is reduced. Therefore, it is advantageous upon controlling the temperature of the toner.

Hereinafter, the embodiments according to the present invention will be described with reference to the drawings.

FIG. 1 is a schematic diagram showing the first embodiment of the image printing apparatus according to the present invention in accordance with the electrophotographic method using a liquid developer.

The image printing apparatus of FIG. 1 is equipped with a latent image retaining member 1 having a photosensitive layer on its surface, and, for example, a photosensitive drum having a structure that an organic-based or amorphous silicon-based photosensitive layer is provided on the base body formed of an electric conductor such as aluminum and having a thickness of approximately 2 mm to 5 mm can be used for the latent image retaining member. If necessary, the surface of this photosensitive layer may be covered with a layer of a releaser. Around the latent image retaining member 1, four sets of electrostatic chargers 2-1 through 2-4 and developer units 4-1 through 4-4 are arranged so that the images of four colors, i.e. yellow, magenta, cyan and black, are possibly developed.

The latent image retaining member 1 rotates in the direction of the arrow in the drawing, and an electrostatic latent image is generated on it by the charge with the electrostatic charger 2-1 and the exposure to light radiation 3-1 using the exposure device for providing a exposed portion and a non-exposed portion. The developer unit 4-1 develops this electrostatic latent image. The developer unit 4-1 has a container for containing a liquid developer and a developing electrode in a roller shape. The developing electrode is arranged to face the latent image retaining member 1 but avoiding contact with the latent image retaining member 1, and the developing voltage is applied. The liquid developer is carried to the clearance between the development electrode and the latent image retaining member 1 by rotating the roller-shape development electrode, so that the development of electrostatic latent image is performed to make a visible image for the first color. Similarly, the images for the second through fourth colors are made visible by developing the electrostatic latent image generated by the light radiations 3-2 through 3-4 utilizing the electrostatic chargers 2-2 through 2-4 and the developer units 4-2 through 4-4.

The liquid developer is composed of a non-polar carrier liquid such as Isoper L (trade name of product manufactured and sold by Exxon Mobil Chemical Co.) and toner particles dispersed in the carrier liquid. These toner particles agglomerate and attach onto the photosensitive layer corresponding to the electrostatic latent image, and a visible image is formed of the toner particles accordingly.

The visible image thus formed on the surface of the latent image retaining member 1 and containing the carrier liquid becomes a toner image in an approximately dried state by removing the carrier liquid with use of a carrier removal member 5 such as squeeze, suction nozzle and the like (the embodiment shown in the drawing uses a suction nozzle). The toner image is then pressed on the intermediate transfer medium 6 such as intermediate transfer drum or the like to transfer the toner image.

The toner image transferred to the intermediate transfer medium 6 is contacted and pressed to the print medium 8 such as paper which is fed by means of a press roller 7, so that the toner image is press transferred to the print medium. On the other hand, the latent image retaining member 1 after the toner image is transferred to the intermediate transfer medium 6 is subjected to a treatment for removing a residual toner on the surface by a cleaner (not shown), before the above-described image formation process is repeated.

Figure 10:
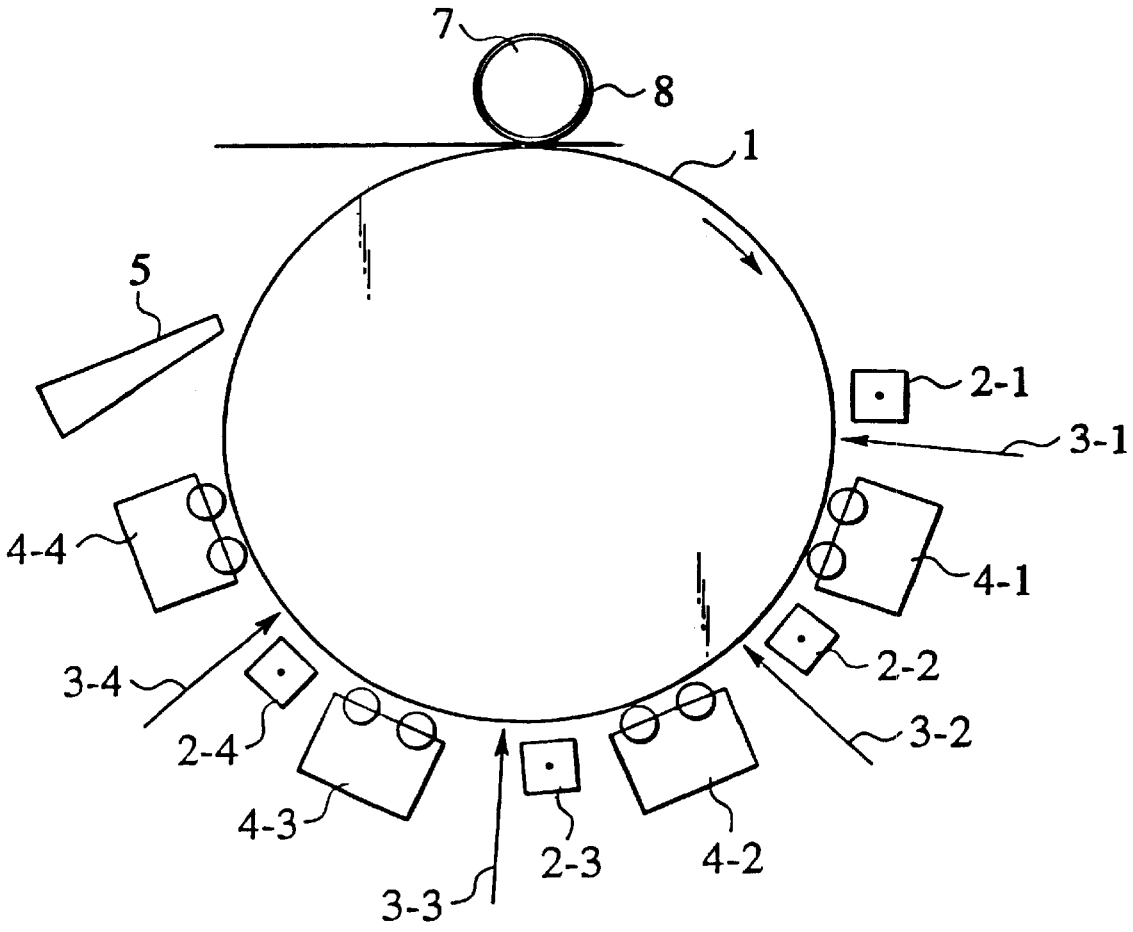
FIG. 10 is a schematic diagram showing another embodiment of the image printing apparatus of the present invention.

It should be noted that, in the above embodiment, the primary transfer from the latent image retaining member to the intermediate transfer medium is not limited to the press transferring and other conventionally known transferring manners such as electric field transfer may be employed. Moreover, it is also possible to omit the intermediate transfer medium and employ a procedure to transfer the toner image direct to the print medium from the latent image retaining member, as shown in FIG. 10.

For the electrostatic chargers 2-1 through 2-4, any type of a charger may be employed if only it can charge up the latent image retaining member, and, for example, a corona charger or the like is possibly used. In common, it electrifies in the range from about 500 V to about 1,000 V.

As for the exposure device, a radiation device which emits, for example, laser beam or the like as the light radiations 3-1 through 3-4 is employed, and the exposure is regulated so that the electric potential at the image section of the maximum density is within the range from about 0 V to about 500 V.

As to the developer units 4-1 through 4-4, the roller type development electrode (developing roller) is used, and the liquid developer in the developper container is carried to the location proximate to the latent image retaining member by rotating the developing roller. The electric voltage applied to the developing roller is adjusted to set the electric potential to a value between the electric potential at the image area with the maximum density and the electric potential at the non-image area. More specifically, the difference between the electric potentials of the maximum density image area and the developing roller (or developing potential difference) is set in the range from 100 V to 500 V. The gap or clearance between the surface of the developing roller and the surface of the latent image retaining member is commonly set in the range from about 10 micrometers to about 200 micrometers.

The above-described embodiment is an example in which the development is performed by superimposing the images of respective colors on the latent image retaining member in accordance with the discharge area development method by positive charge toner. However, the method and manners of development are not limited to those of this embodiment and it is possible to appropriately change and select the color superimposing manner, the polarity of the electric charge, the type of development such as discharged or charged area development and the like are changed.

In the above-described image printing apparatus, the temperature of the toner is adjusted by controlling the temperatures of the intermediate transfer medium 6 and the print medium 8 so that the complex viscosity coefficient of the toner, $\eta$ (Pa·s), at the time of transfer to the print medium satisfies the following expression.

$$1\times10^4<\eta<1\times10^6$$

The complex viscosity coefficient of the toner, $\eta$, varies according to the components and composition such as a binder resin constituting the toner and the like. However, in any case, there is a correlation between the complex viscosity coefficient and the temperature, and the complex viscosity coefficient, $\eta$, decreases in general according as the temperature rises. Therefore, the correlation between the complex viscosity coefficient, $\eta$, of the toner and the temperature is previously examined and the appropriate temperature range in which the above-described expression is satisfied is determined, before the temperatures of the intermediate transfer medium 6 and the print medium 8 are set so that the temperature of the toner image is in this appropriate temperature range. When the temperature is controlled so that the complex viscosity coefficient, $\eta$, of the toner is $1\times10^6$ or less, it is possible to perform the excellent secondary transfer, with inhibiting from generating the transfer residual. However, if the temperature is controlled so that the complex viscosity coefficient of the toner is $1\times10^4$ or less, lowering occurs to the density of the transfered image. The temperatures of the intermediate transfer medium 6 and the print medium 8 are not necessarily identical with each other, and the toner image can be conditioned for the state satisfying the above-described expression also in the case of setting them so that, for example, the mean temperature of them is in the above-described appropriate temperature range.

Figure 8:
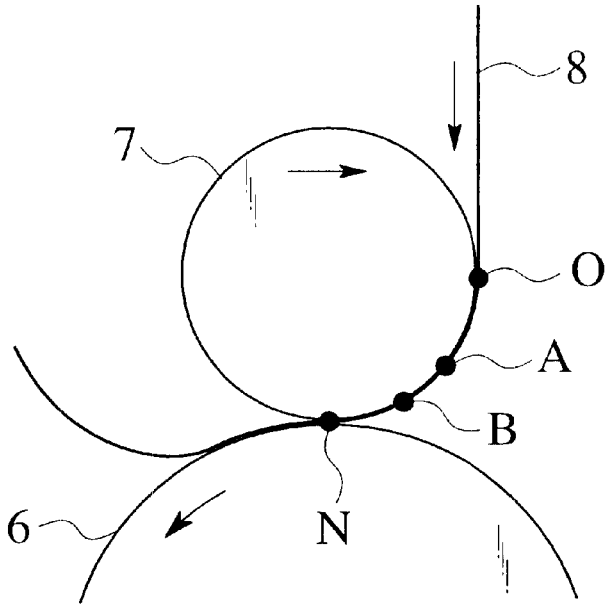
FIG. 8 is a diagram for illustrating the definition of the temperature of the print medium.

The temperature of the intermediate transfer medium 6 and the print medium 8 can be controlled by using a heating device such as a variety of heaters, cooling system, temperature detectors and a control unit. The temperature at the transfer nip of the print medium 8 can be defined as follows:

First, in the case where the print medium 8 is carried in a state of being wound on a press roller 7 at the upstream side of the transfer nip, as shown in FIG. 8, the temperature is estimated as described below. Specifically, the temperature measurement is performed at the point A and the point B shown in FIG. 8 during carrying of the print medium. Here, if there is a temperature difference between the press roller 7 and the print medium 8 prior to the event that they contact with one another at the point O, a difference is often made between the temperature TA at the point A and the temperature TB at the point B. Supposing that the time period required for movement of the print medium from the point A to the point B is tAB, and similarly supposing that the time period required for moving from the point B to the point N which is the upstream end portion of the transfer nip is tBN, if tAB and tBN are appropriately short and both take almost same values, a print medium temperature change coefficient ZAB between the points A and B and a temperature change coefficient ZBN between the points B and N are considered as being approximately same, and they can be approximated by the primary expression as follows, wherein TN represents the print medium temperature at the point N.

$$ZAB \approx ZBN = (TB-TA)/tAB \approx (TN-TB)/tBN$$

Accordingly, TN is estimated as follows:

$$TN = TB + tBN\ (TB-TA)/tAB$$

Figure 9:
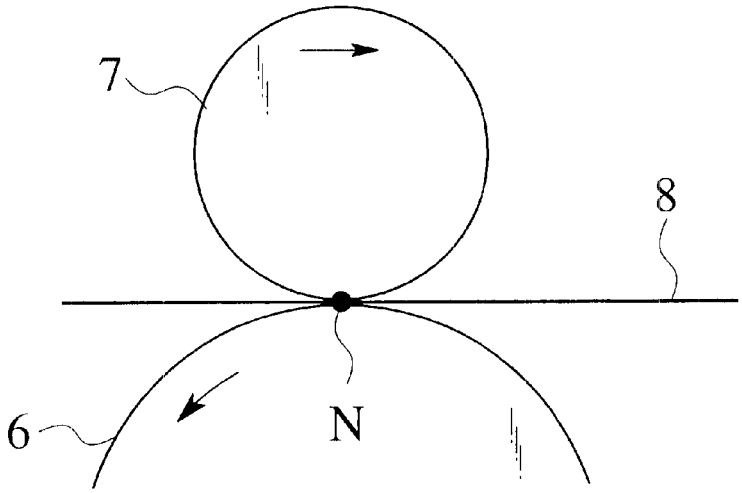
FIG. 9 is another diagram for illustrating the definition of the temperature of the print medium.

Moreover, in the case where the print medium 8 was carried without winding on the press roller 7, as shown in FIG. 9, the print medium temperature TN at the point N being the upstream end portion of the transfer nip is equal to the temperature TO at the point O in FIG. 8 as follows.

$$TN = TO$$

It should be noted that, in the embodiments of the present application, the temperature measurement of the print medium is performed using the non-contact thermometer IT2-80 manufactured by Keyence Corporation. Moreover, it has been confirmed that, in the case of using art paper or PPC paper as in the examples of the present application, the temperature values measured by the thermometer are possibly consistent with the measurement values of the conventional contact type thermocouple thermometer by presetting the emissivity of the thermometer to 0.98. Therefore, the measurement was performed using this preset value.

Moreover, in the case of using blowing air in order to remove the carrier liquid from the toner image on the latent image retaining member 1 or the intermediate transfer medium 6, it is also possible to supply or remove heat by the air.

It should be noted that the complex viscosity coefficient, $\eta$, of the toner in the above-described expression is a value which is obtained when the viscoelastic property of the toner solid content is measured at the temperature dropping rate of 3 dgrees centigrade/min. under the strain condition of ±0.025 radian in the rotational test geometry mode using parallel plates of a diameter of 12 mm with a gap of 0.5 mm by utilizing Rheos system manufactured by Rheometric Scientific, Co., Ltd., as a device.

FIG. 2 through FIG. 5 are graphs showing the relationship between the secondary transfer temperature and the density or the lightness of the image transferred on the print medium in the case where art paper or PPC paper is used as the print medium (see Example described later on the details). From these graphs, it is understood that the deterioration of the image quality, particularly in the transfer to the paper whose surface is coarse, occurs when the complex viscosity coefficient does not satisfy the above-described expression as the temperature at the time of transferring exceeds the appropriate range.

In the image printing apparatus of FIG. 1, the paper is wound and fixed on the press roller and the secondary transfer is then performed, in order to make sure the paper contacted with the intermediate transfer medium is instantly peeled off the intermediate transfer medium. In this regard, it is common to construct the apparatus in such a manner that the print medium 8 is transported between the intermediate transfer medium 6 and the press roller 7 in the tangential direction.

Figure 6:
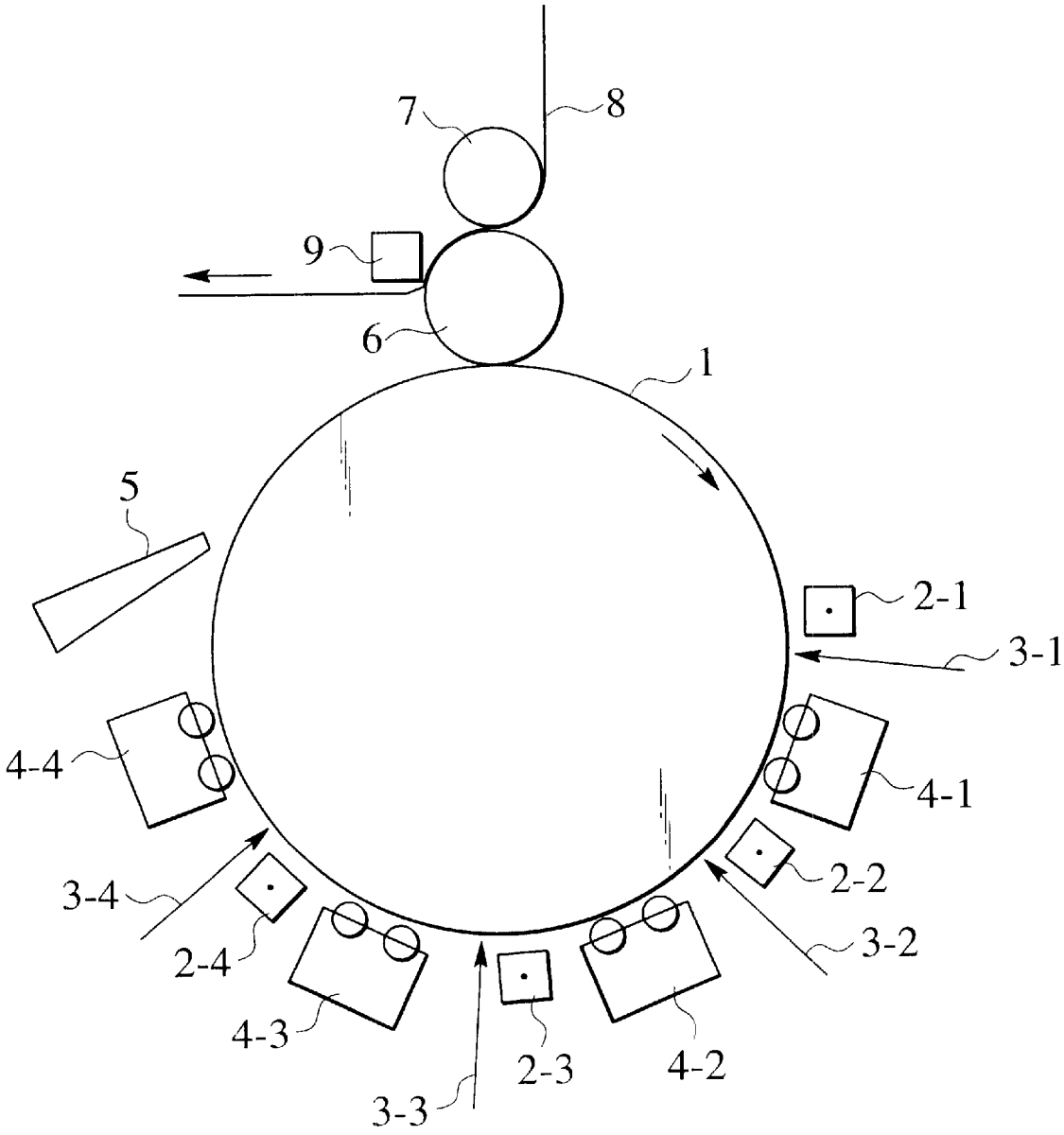
FIG. 6 is a schematic diagram showing the second embodiment of an image forming apparatus for carrying out a method of forming an image of the present invention.

On the other hand, FIG. 6 shows the second embodiment of an image printing apparatus. In this embodiment, the development of latent image is carried out similarly to FIG. 1, however, the transferring of the formed toner image to the print medium is different. Specifically, it is arranged so that the contact with the paper is maintained for a certain degree of time period after the moment when the toner image on the intermediate transfer medium is contacted and press to the paper. Concretely, that can be realized with, for example, tackiness of the surface of the intermediate transfer medium. In the case where the primary transfer is performed by press transfer system, if the tackiness of the surface of the intermediate transfer medium 6 is higher than that of the latent image retaining member 1, the toner image on the latent image retaining member 1 is easily transferred to the intermediate transfer medium 6. Therefore, it is effective that a slight tackiness is imparted to the surface of the intermediate transfer medium B. In this case, if the tackiness of the surface of the press roller 7 is low, the print medium 8 is carried with the intermediate transfer medium 6 in accordance with the rotation while adhering to it. Accordingly, the contact of the print medium 8 with the toner image and intermediate transfer medium 6 is maintained. The time period for which the contact is maintained is changed depending upon the tackiness of the surface of the intermediate transfer medium 6 and the repulsion due to the rigidity (elasticity) of the print medium 8, and the adjustment of the contacting time period is easily performed by enhancing the tackiness on the surface of the intermediate transfer medium 6 to a certain extent and providing the peeling member 9 for forcedly releasing the print medium 8 from the intermediate transfer medium 6. For the peeling member 9, a squeeze, a roller whose surface tackiness is higher than that of the intermediate transfer medium 6, an suction nozzle and the like can be used.

Therefore, the paper winded on the press roller 7 at the upstream side of the secondary transfer nip is then winded on the intermediate transfer drum at the downstream side of the secondary transfer nip by utilizing the tackiness of the intermediate transfer medium 6 and carried with it until it is peeled off.

In this way, the transfer property of the toner image is enhanced by carrying the print medium 8 for the predetermined time period in the circumferential direction while maintaining the contact of the print medium 8 with the intermediate transfer medium 6. It is more effective that a roller or an air blower for pressurizing the contact of the print medium 8 to the intermediate transfer medium 6 is provided between the press roller 7 and the peeling member 9. The similar effect is obtained also in the case where toner image is direct transferred from the latent image retaining member 1 to the recording medium by arranging the structure so that the print medium is carried along the circumferential direction of the latent image retaining member 1 while maintaining the contact of the print medium with the latent image retaining member 1.

When the starting point at which the contacting time period starts between the print medium 8 and the intermediate transfer medium 6 is defined as the downstream end of the transfer nip provided on the pressing section of the intermediate transfer drum and the press roller, the contact time may be preset to 0.1 second or more, and preferably 0.2 seconds or more. In this condition, the toner image is excellently transferred and the transfer failure becomes not easily occurred, even if the transfer temperature of the toner image is a comparatively lower temperature around 70 degrees centigrade. Moreover, the maximum density is possibly achieved in the entire temperature range.

The above-described tendency can be seen in the various cases where the kind of toner, the thickness of the toner layer, the kind of paper and the like are changed, except for the behavior of optical density in the case where a patch of shadow image is printed on the art paper, that is, in the case where the density rising effect produced in accordance with the rising of the glossiness is larger than the density lowering effect due to the toner getting into the concave portions of the paper, and it is significant as these transfer conditions are bad.

As to the embodiment of the image printing method of the present invention, it may be arranged to comprise the step for peeling the print medium from the image carrying member after the press contacting of the print medium and the toner image is maintained for the time period of 0.1 second to 10 seconds.

Moreover, it may also be arranged so that the toner image, being developed on the surface of the latent image retaining member, is pressed and transferred from the surface of the latent image retaining member to the print medium. Alternatively, it may be arranged so that the toner image, being developed on the surface of the latent image retaining member, is primarily transferred from the latent image retaining member to the surface of the intermediate transfer medium and then pressed and transferred from the surface of the intermediate transfer medium to the print medium.

Upon the primary transfer, it can be arranged so that the pressure is provided between the surface of the latent image retaining member and the surface of the intermediate transfer medium.

As to the embodiment of an image printing apparatus of the present invention, it can be constructed so as to comprise a peeling member which releases the print medium from the image carrying member after the contact between the print medium and the press contacted toner image is maintained for 0.1 second to 10 seconds.

The image carrying member can be formed in a drum shape.

The image carrying member can be an intermediate transfer medium which is disposed adjoining or close to the surface of the latent image retaining member.

It can also be constructed so that the surface temperature of the pressing member which presses and contacts the print medium to the image carrying member is controlled by the temperature control unit.

EXAMPLES

Hereinafter, examples of the present invention will be described in detail with reference to results of the experiments. However, the present invention is not limited to the following examples.

Example 1

Preparation of Liquid Developer

Three liquid developers for three colors were prepared as follows, using: Isoper L (trade name of the carrier liquid manufactured by Exxon Mobile Chemical, Co., Ltd.) as a carrier liquid; an acryl ester based copolymer, as a binder resin, prepared by utilizing lauryl methacrylate, butyl methacrylate, ethyl methacrylate, and methyl methacrylate as a monomer; and pigments (trade name: Cyanine Blue-KRO, and Permanent Carmine 3811) manufactured by Sanyo Dyestuff, Co., Ltd. of Japan and a pigment (trade name: #260) manufactured by Mitsubishi Chemical, Corp. of Japan as toner pigments. Here, the weight ratio of the binder resin to the pigment was made as being 4/1.

First, the binder resin and the pigment were introduced into a paint shaker along with the above-described carrier liquid, and a condensed developer was obtained by mixing and dispersing them in the presence of the glass beads. This was then diluted so that the concentration of non-volatile content is one weight portion, and further, zilconium naphthenate (manufactured by Dainippon Ink, Co., Ltd. of Japan) was added so that the ratio of zilconium naphthenate to the non-volatile content of the above liquid developer was 1/10 parts by weight, to obtain the final liquid developer.

Complex Viscosity Coefficient, η, of Toner

Measurement of the viscoelastic property of the toner solid content of the above-described liquid developers was carried out as the follows:

The viscoelastic property of the toner solid content was measured under the strain condition of ±0.025 radian in the rotational test geometry mode using parallel plates with a gap of 0.5 mm and a diameter of 12 mm by utilizing Rheosystem made by Rheometric Scientific, Co., Ltd., as a device. The temperature drop rate was set to 3 degrees centigrade/minute.

For each toner, the relationship between the complex viscosity coefficient of each toner and the temperature is shown in Table 1.

TABLE 1

Complex viscosity coefficient (Pa · s) of toner

| Temperature (degree C.) | Magenta toner | Cyan toner | Black toner |
|---|---|---|---|
| 70 | $1 \times 10^6$ | $1 \times 10^6$ | $1 \times 10^6$ |
| 90 | $8 \times 10^4$ | $1.5 \times 10^5$ | $8 \times 10^4$ |
| 110 | $1 \times 10^4$ | $3 \times 10^4$ | $1 \times 10^4$ |
| 130 | $3 \times 10^3$ | $1 \times 10^4$ | $3 \times 10^3$ |
| 150 | $2 \times 10^3$ | $5 \times 10^3$ | $2 \times 10^3$ |

Image Printing

Using the image printing apparatus as shown in FIG. 1, the following image formation was carried out with the liquid developer prepared in the above-described procedure. Here, it should be noted that, for the latent image retaining member 1 of the image printing apparatus, a photosensitive drum that an amorphous silicon photosensitive layer having a thickness of 30 micrometers is formed on the surface of a drum made of aluminum was used. And, for the electrostatic charger, a corona charger was used, which was set so that the surface of the photosensitive drum is electrified at 800 V. For the exposure device, it was preset so that the electric potential of the portion subjected to the exposure treatment with the laser beam was either 100 V or 500 V, to form the electrostatic latent image on the surface of the photosensitive drum. The shape of the electrostatic image was preset for a patch of solid image of 10 mm×10 mm. The developing roller used in the developing unit was a roller type electrode of 17 mm diameter, and the gap to the surface of the photosensitive drum was 150 micrometers. The voltage applied to the roller type electrode was 600 V. The above conditions were determined so that a patch of shadow image of a relatively thick toner film was to be developed on the exposed portion whose electric potential was 100 V, and a patch of highlight image of a relatively thin toner film was to be developed on the exposed portion whose electric potential section was 500 V.

In accordance with the above, a solid image in a square of 10 mm×10 mm was developed on the photosensitive drum and almost all of the carrier liquid was removed by the squeeze roller of the developing unit. Moreover, the suction nozzle was operated as a carrier removing member 5 so that the carrier liquid still remaining on the photosensitive drum was substantially completely removed.

The toner image formed on the photosensitive drum was press transferred onto the intermediate transfer medium which was arranged to contact with it under pressure. During this procedure, the temperature of the photosensitive drum was adjusted to room temperature and the temperature of the intermediate transfer medium 6 was adjusted to a constant temperature which was determined in the range of 60 to 160 degrees centigrade. For the intermediate transfer medium, a intermediate transfer drum in which a silicone rubber layer in a thickness of about 1 mm was provided was employed. The press contact between the intermediate transfer drum and the latent image retaining member was provided by applying a load of about 90 kg for the width of A4 size of the contacting portion to pressurize to each other. At this time, it was confirmed that the transfer efficiency was approximately 100% and the transfer residual of the toner was scarcely seen on the photosensitive drum.

The toner image transferred primarily to the intermediate transfer drum was subsequently transferred secondarily to the print medium 8, using the press roller 7. During this procedure, the temperature of the print medium was adjusted to a constant temperature within the range of 60 to 160 degrees centigrade. Moreover, the print medium 8 was wound upon the press roller to fix on the surface thereof, and the intermediate transfer drum and the press roller were contacted to one another under pressure by applying a load of about 54 kg for the width of A4 size, whereby the image was press transferred and printed.

Measurement of Image Quality

Figure 2:
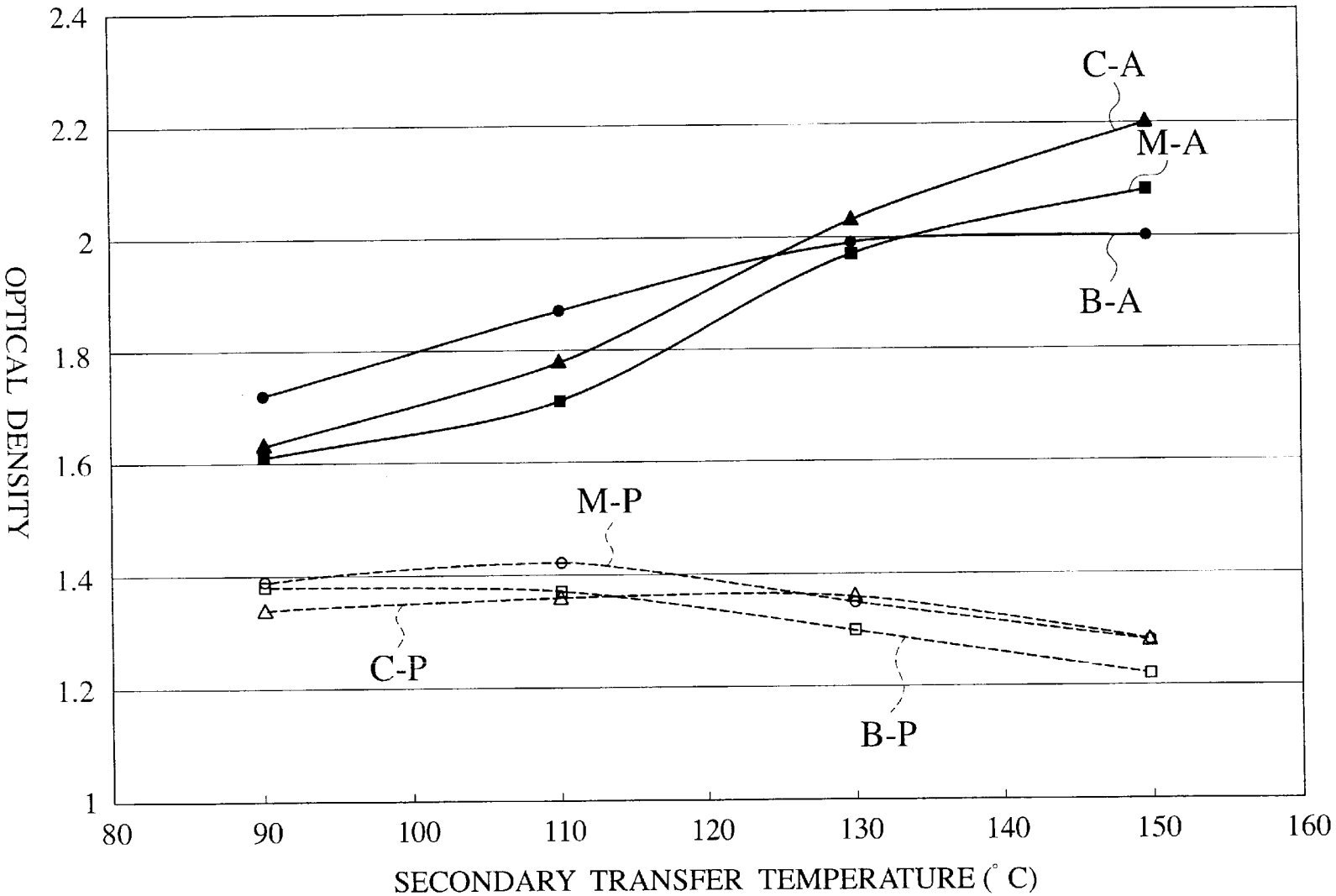
FIG. 2 is a graph showing the relationship between the optical density of shadow patch image and the transfer temperature.
Figure 3:
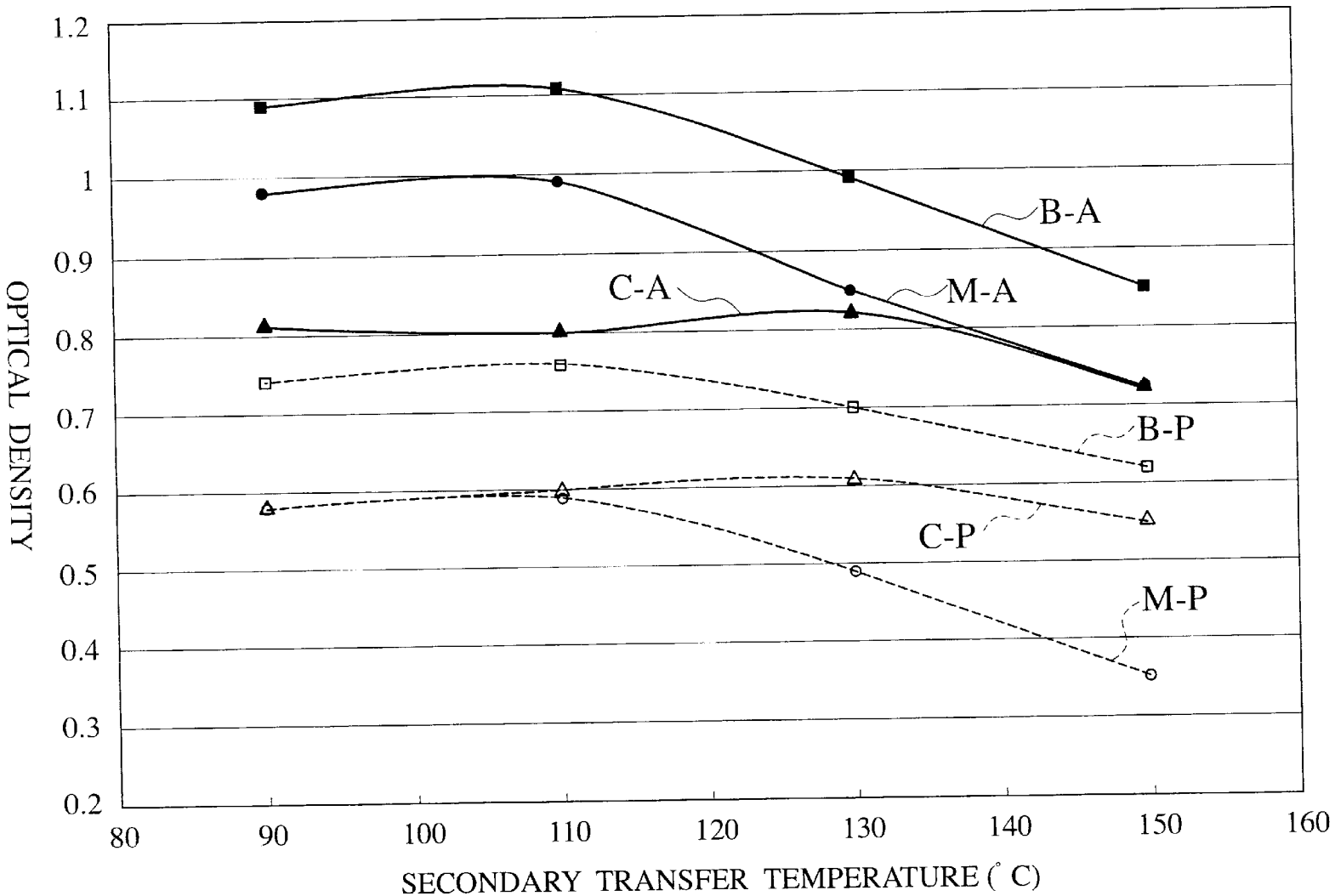
FIG. 3 is a graph showing the relationship between the optical density of highlight patch image and the transfer temperature.
Figure 4:
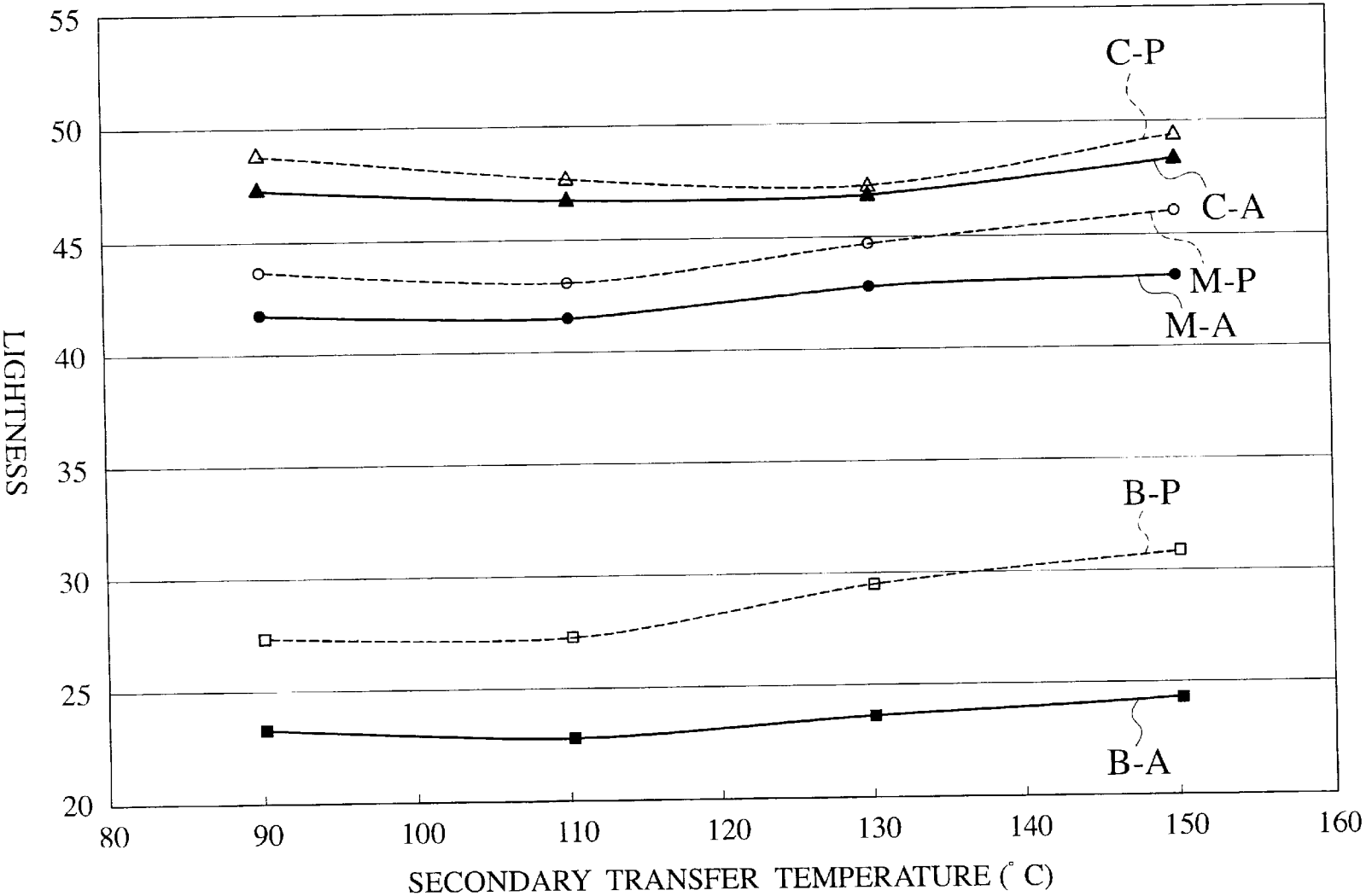
FIG. 4 is a graph showing the relationship between the lightness of the shadow patch image and the transfer temperature.
Figure 5:
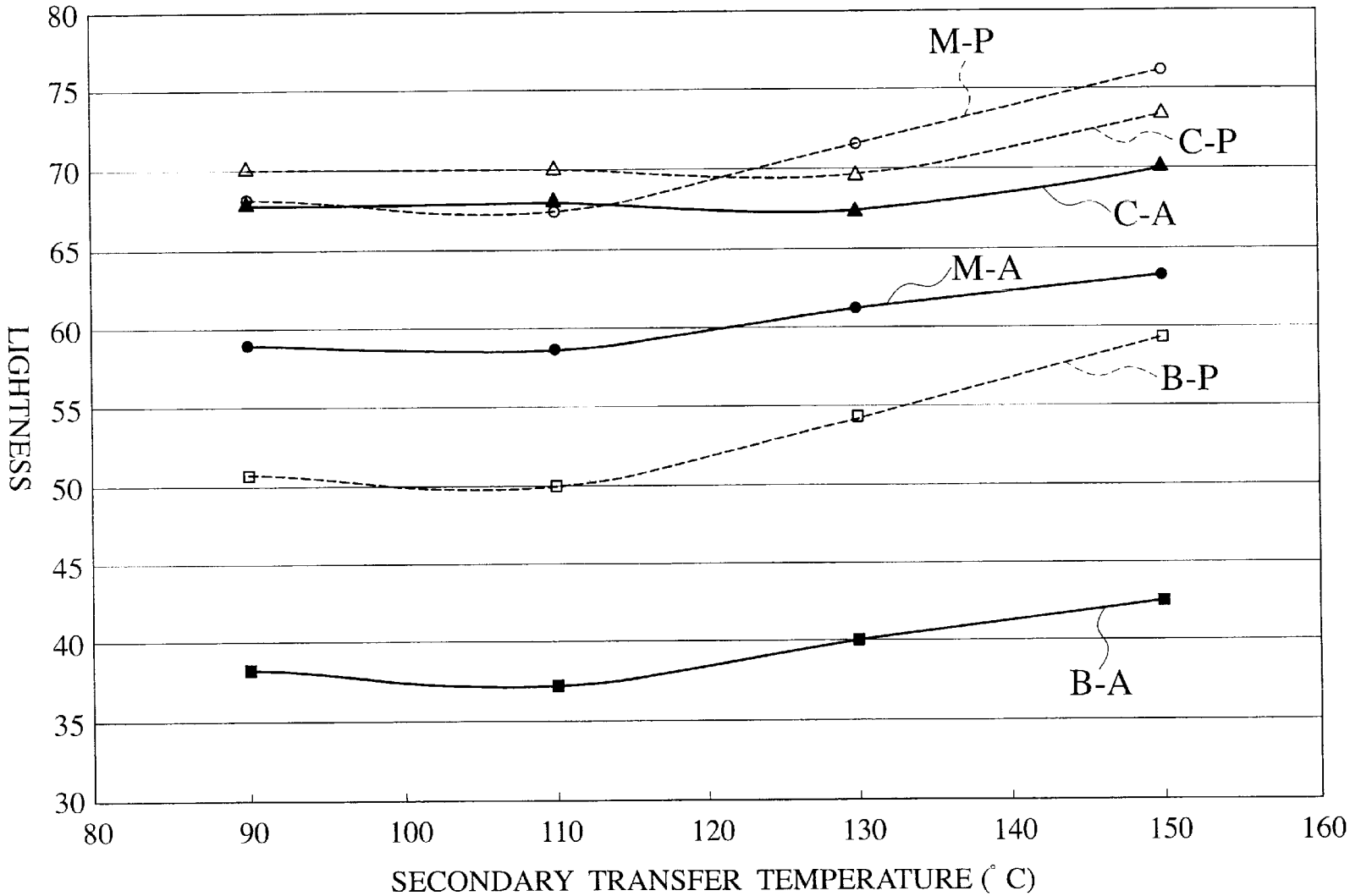
FIG. 5 is a graph showing the relationship between the lightness of the highlight patch image and the transfer temperature.

In the above-described image printing, the secondary transfer temperature was controlled for different temperatures by adjusting the temperatures of the intermediate transfer drum and the recording medium 8 in the range of 60 to 160 degrees centigrade, and a patch of solid image was output on the print medium, using two kinds of paper, art paper (trade name: both-side art 135 K, made by Kobayashi Kirokushi Co., Ltd.) and PPC paper (trade name: Color Laser Copier Paper TKCLA4, sold by Canon Inc.) as the print medium 8. For each of the printed patches of solid image, the measurement of image density using an optical density meter (trade name: RD914, manufactured by Process Measurements Co., Ltd.) and the lightness measurement using spectophotometric colorimetry (trade name: CM-3500D, manufactured by Minolta, Co., Ltd.) were performed. The results are shown in FIGS. 2 through 5. FIG. 2 and FIG. 3 are graphs each showing the relationship between the secondary transfer temperature and the optical density of the printed image, and FIG. 4 and FIG. 5 are graphs each showing the relationship between the secondary transfer temperature and the lightness of the recording image. FIG. 2 and FIG. 4 are the results of measurement in the patch of shadow image (image of a thick toner layer), and FIG. 3 and FIG. 5 are the results of measurement in the patch of highlight image (image of a thin toner layer). For the reference letters in the graphic representations, M-A denotes the image of magenta toner on the art paper, C-A denotes the image of cyan toner on the art paper, B-A denotes the image of black toner on the art paper, M-P denotes the image of magenta toner on the PPC paper, C-P denotes the image of cyan toner on the PPC paper, and B-P denotes the image of black toner on the PPC paper.

In FIGS. 2 through 5, the following tendencies are observed, except for the optical density of the image in the case where the shadow image was output on the art paper.

(1) The image density changes according to the secondary transferring temperature, and the drastic fall of image density is occurred, in general, when it is approximately the following temperature, T1, or more.

Magenta toner: T1=110 degrees centigrade

Cyan toner: T1=130 degrees centigrade

Black toner: T1=110 degrees centigrade (2) The fall of the image density at the temperature of T1 or more in the case of using the PPC paper is larger than that of the art paper.

(3) The fall of the image density at the temperature of T1 or more in the case of printing the highlight image is larger than that of the shadow image.

The above-described tendencies are similarly seen in the case where the load on the seondary transfer at the press roller 7 is changed to 36 kg and 70 kg.

It is understood from Table 1 that the temperature, T1, at which the image density on the paper begins to drastically fall corresponds to such a temperature that the complex viscosity coefficient of the toner at the time of secondary transfer reaches the range of $1\times10^4$ Pa·s or less.

Moreover, when the above image printing operation was repeated, excepting that the secondary transfer temperature was changed to 70 degrees centigrade, the partial transfer failure occured on the images of every toner, especially in the case of using the PPC paper, and residual toner was observed on the intermediate transfer drum after printing. It is understood from Table 1 that the temperature at which the secondary transfer failure occurs corresponds to such a temperature that the complex viscosity coefficient of the toner at the time of secondary transfer reaches the range of $1\times10^6$ Pa·s or more.

Moreover, it is noted that the similar results to the above are obtained also in the case of using, as a resin for composing the toner particles, a variety of acryl ester copolymer prepared with the monomers which are appropriately selected and combined from acrylic acid, vinyl acetate, styrene, lauryl acrylate, lauryl methacrylate, butyl acrylate, butyl methacrylate, ethyl acrylate, ethyl methacrylate, methyl acrylate and methyl methacrylate.

Example 2

Figure 7:
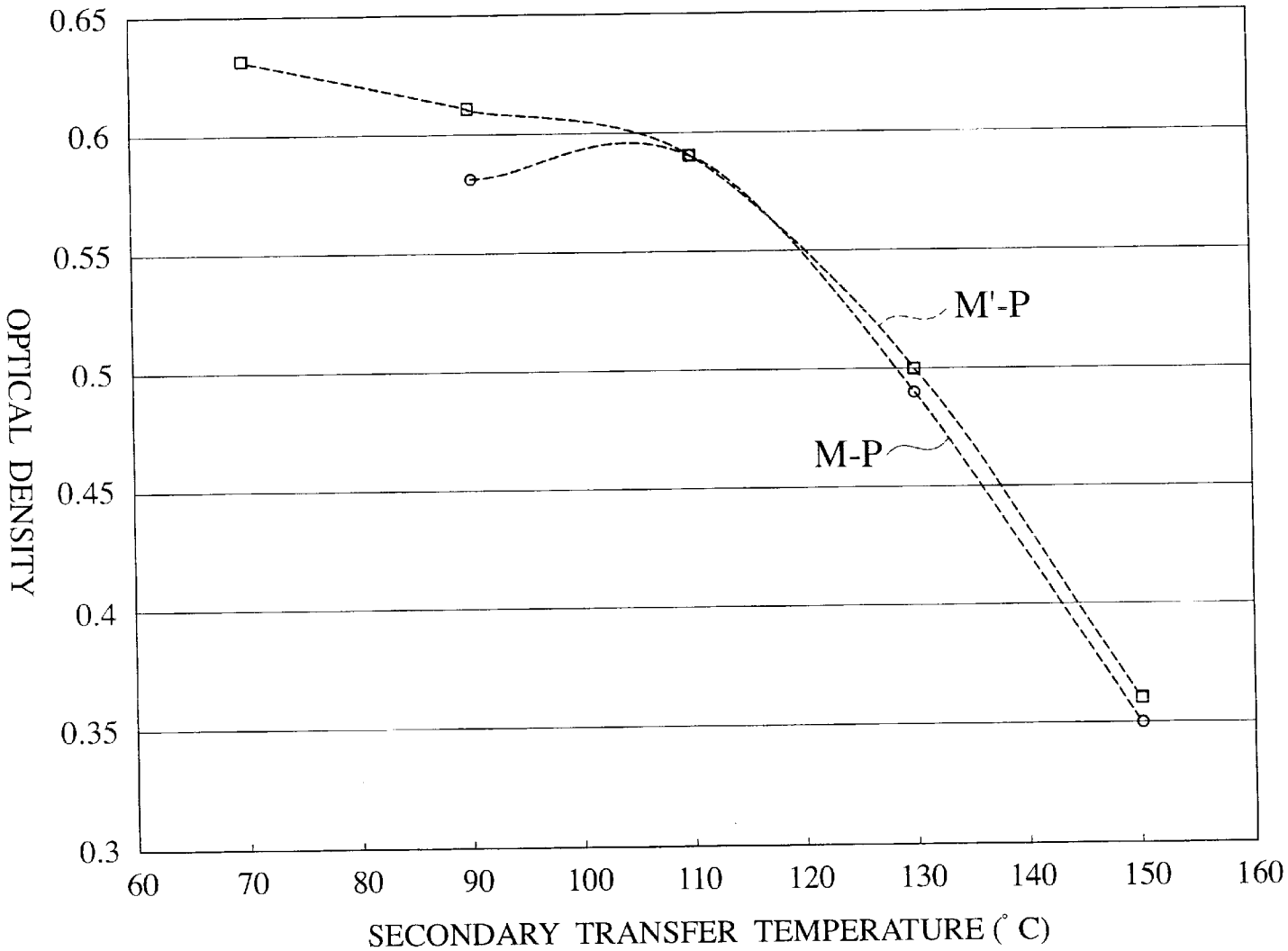
FIG. 7 is a graph showing the effect of the contacting time during the image transfer on the relationship between the optical density of the highlight patch image and the transfer temperature.

For printing a patch of the highlight image with the magenta toner on the PPC paper, the image printing operation of Example 1 was repeated, excepting that the image printing apparatus was changed as shown in FIG. 6, wherein the print medium was peeled after a preset time period during which the contact of the print medium 8 with the intermediate transfer medium 6 made by pressing by means of the press roller 7 was kept, and excepting that the preset range of the secondary transfer temperature was changed to a range of 70 to 150 degrees centigrade. Here, in the above operation, the time period during which the paper was contacted with the intermediate transfer drum was set to 0.1 second. The the optical density of the image was measured similarly. The relationship between the optical density and the secondary transferring temperature (M'-P in the graph) is shown in FIG. 7. In the graph, the result of the highlight image with magenta toner in Example 1 (M-P) is also shown for comparison. It should be noted that the starting point of the contacting time period was made at the downstream end of the press nip formed at the pressing section between the intermediate transfer drum and the press roller.

From the graph, it is understood that, if the contact time period of the paper and the intermediate transfer medium is appropriately elongated, the secondary transfer is possibly performed even at 70 degrees centigrade that the transfer failure was generated in Example 1, so that the maximum density can be obtained in the whole of the temperature range.

Furthermore, the same image printing was repeated, excepting that the contact time period between the paper and the intermediate transfer medium was changed. As a result, the secondary transfer failure was generated in the case where the contacting time period was shortened to 0.07 seconds, but the secondary transfer in each of the cases where it was set at 0.14 seconds, 1 second, 5 seconds and 10 seconds was appropriately performed. And, the manner of change in the density of the solid image patch was approximately the same as that of FIG. 7.

Moreover, the above-described tendencies were similarly observed even when the kinds of toners, the thickness of the toner layers, the kinds of papers were changed, excepting the change of optical density in the case where the shadow image was output on the art paper.

As described above, according to the present invention, it is possible to realize a method and an apparatus for printing images by wet type image development in which the deterioration of the image quality at the time of transfer is slight, and a high quality image is capable of being repeatedly output for a long time period. Moreover, it is advantageous from the viewpoints of energy saving due to the lowering of the temperature at the time of transfer, extention of the lifespan and the performance properties of the latent image retainer and the intermediate transfer medium and the wide selection of materials.

This application claims benefit of priority under 35 U.S.C. §119 to Japanese Patent Application No. 2001-090497, filed on Mar. 27, 2001, the entire contents of which are incorporated by reference herein.

It must be understood that the invention is in no way limited to the above embodiments and that many changes may be brought about therein without departing from the scope of the invention as defined by the appended claims.

What is claimed is:

1. A method of printing an image on a print medium with a liquid developer which comprises a liquid carrier and a toner dispersed in the liquid carrier, comprising:

forming a toner image comprising the toner, from the liquid developer;

transferring the toner image to the print medium under pressure;

controlling the toner image to be transferred to the print medium, by adjusting a complex viscosity coefficient of the toner forming the toner image to be transferred, to a value satisfying the formula: $1\times10^4<\eta<1\times10^6$, where $\eta$ represents the complex viscosity coefficient (Pa·s) of the toner;

pressing the toner image to the print medium; and keeping the print medium in contact with the toner image for a predetermined time period after the pressing of the toner image.

2. The image printing method of claim 1, wherein the complex viscosity coefficient of the toner varies with the temperature of the toner, and the controlling of the toner image comprises:

regulating the temperature of the toner image to be transferred, to a predetermined temperature at which the complex viscosity coefficient of the toner satisfies said formula: $1\times10^4<\eta<1\times10^6$.

3. The image printing method of claim 2, further comprises, before the forming of the toner image:

searching variation of the complex viscosity coefficient of the toner with the temperature to determine the predetermined temperature.

4. The image printing method of claim 3, wherein the toner of the liquid developer comprises an acrylic ester copolymer resin and a colorant, and the predetermined temperature regulated for the toner image to be transferred is higher than 70 degrees centigrade and lower than 110 degrees centigrade.

5. The image printing method of claim 1, wherein the predetermined time period is in a range from 0.1 to 10 seconds.

6. The image printing method of claim 1, wherein the predetermined time period is in a range from 0.2 to 10 seconds.

7. The image printing method of claim 1, wherein the toner image from the liquid developer is formed on a latent image retaining member, and the toner image formed on the latent image retaining member is transferred direct to the print medium.

8. The image printing method of claim 1, wherein the toner image from the liquid developer is formed on a latent image retaining member, and the transferring of the toner image comprises:

primary transferring the toner image formed on the latent image retaining member to an intermediate transfer medium; and secondary transferring the toner image under pressure from the intermediate transfer medium to the print medium.

9. The image printing method of claim 8, wherein the toner image at the primary transferring is transferred under pressure by pressing the toner image to the intermediate transfer member.

10. A method of printing an image on a print medium with a liquid developer which comprises a liquid carrier and a particulate toner dispersed in the liquid carrier, comprising:

forming a toner image comprising the particulate toner, from the liquid developer;

transferring the toner image to the print medium under pressure;

controlling the toner image to be transferred to the print medium, by adjusting a complex viscosity coefficient of the particulate toner forming the toner image to be transferred, to a value that satisfies the formula: $1\times10^4<\eta<1\times10^6$, where $\eta$ represents the complex viscosity coefficient (Pa·s) of the particulate toner;

pressing the toner image to the print medium; and keeping the print medium in contact with the toner image for a predetermined time period after the pressing of the toner image.

11. An apparatus for printing an image on a print medium with a liquid developer which comprises a liquid carrier and a toner dispersed in the liquid carrier, comprising:

an image formation system which forms a toner image comprising the toner, from the liquid developer;

a transfer mechanism which is arranged to transfer the toner image to the print medium under pressure;

a temperature controller which controls the temperature of the toner image to be transferred to the print medium by adjusting a complex viscosity coefficient of the toner forming the toner image to be transferred to the print medium to a value satisfying the formula: $1\times10^4<\eta<1\times10^6$, where $\eta$ represents the complex viscosity coefficient (Pa·s) of the toner;

a press member which presses the toner image to the print medium; and a keeping member which keeps the print medium in contact with the toner image for a predetermined time period after the toner image is pressed by the press member.

12. The image printing apparatus of claim 11, wherein the predetermined time period is 0.1 to 10 seconds.

13. The image printing apparatus of claim 11, wherein the transfer mechanism comprises:

an image carrying member having a carrying surface which carries the toner image formed by the image formation system, wherein the contact keeping system comprises tackiness which is imparted to the carrying surface of the image carrying member and makes the print medium adhere to the carrying surface to keep the print medium in contact with the toner image.

14. The image printing apparatus of claim 13, wherein the transfer mechanism comprises:

a releaser which forcingly releases the adhered print medium from the carrying surface.

15. The image printing apparatus of claim 11, wherein the transfer mechanism comprises:

an image carrying member in a drum shape which carries the toner image formed by the image formation system to the print medium.

16. The image printing apparatus of claim 15, wherein the image formation system comprises:

a latent image retaining member having a surface on which the toner image is formed, and wherein the image carrying member includes:

an intermediate transfer medium which is disposed adjoining or close to the surface of the latent image retaining member.

17. The image printing apparatus of claim 15, wherein the temperature controller controls the temperature of the toner image to be transferred, while the toner image is carried by the image carrying member.

18. The image printing apparatus of claim 11, wherein the transfer mechanism comprises a press member which is arranged to press the print medium to the toner image, and the temperature controller adjusts the temperature of the press member to appropriately control the temperature of the toner image to be transferred to the print medium.

19. An apparatus for printing an image on a print medium with a liquid developer which comprises a liquid carrier and a toner dispersed in the liquid carrier, comprising:

an image formation system which forms a toner image comprising the toner, from the liquid developer; and a transfer mechanism which is arranged to transfer the toner image to the print medium under pressure;

wherein the transfer mechanism comprises:

an image carrying member having a carrying surface which carries the toner image formed by the image formation system;

a press member which presses the print medium to the toner image on the carrying surface;

a contact keeping system which keeps the print medium in contact with the toner image on the carrying surface for a predetermined time period after the toner image is pressed by the press member; and a releaser configured to release the print medium from image carrying member.

* * * * *